US006056231A

United States Patent [19]

Neifer et al.

[11] Patent Number: 6,056,231

[45] Date of Patent: May 2, 2000

[54] PUSHING MEMBER FOR APPARATUS FOR PAYING OUT A ROLL OF INSULATION MATERIAL

[75] Inventors: Don A. Neifer, Granville, Ohio; Dennis K. Wenrick, Oviedo, Fla.; Ernest J. Plant, Seguin, Tex.

[73] Assignee: Owens Corning Fiberglas Technology, Inc., Summit, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/645,996

[22] Filed: May 14, 1996

[51] Int. Cl.[7] ..... B65H 16/02; E04D 15/00

[52] U.S. Cl. ..... 242/557; 242/570; 52/749.12

[58] Field of Search ..... 52/746.11, 749.12; 242/557, 595, 570, 588

[56] References Cited

U.S. PATENT DOCUMENTS

| | | | |
|---|---|---|---|
| 3,559,914 | 2/1971 | Alderman | 242/86.52 |
| 3,969,863 | 7/1976 | Alderman | 52/407 |
| 4,047,345 | 9/1977 | Alderman | 52/404 |
| 4,047,346 | 9/1977 | Alderman | 52/407 |
| 4,068,446 | 1/1978 | Brueske | 52/747 |
| 4,075,807 | 2/1978 | Alderman | 52/407 |
| 4,147,003 | 4/1979 | Alderman | 52/309.8 |
| 4,222,212 | 9/1980 | Alderman | 52/749 |
| 4,366,933 | 1/1983 | Broussard | 242/557 |
| 4,434,601 | 3/1984 | Zellmer | 52/745 |
| 4,967,535 | 11/1990 | Alderman | 52/749 |
| 5,129,462 | 7/1992 | Mail | 242/557 |
| 5,491,952 | 2/1996 | Alderman et al. | 242/557 X |
| 5,553,807 | 9/1996 | Lopez | 242/557 |

*Primary Examiner*—John Q. Nguyen

*Attorney, Agent, or Firm*—Inger H. Eckert; Stephen W. Barns

[57] ABSTRACT

An apparatus for providing a roof structure having a plurality of purlins spaced apart from one another in a parallel arrangement is disclosed. The apparatus includes a carriage which is movable in a downstream direction along the length of the purlins. As the carriage moves in the downstream direction, a support sheet for support of insulation material is payed out so that the support sheet depends from adjacent purlins. The apparatus further includes a plate which is attached to the carriage. The plate supports a roll of insulation material which is unsupported axially. The insulation material is connected at the upstream end of the roof structure and is payed out on top of the support sheet as the carriage moves along the length of the purlins. The apparatus also includes a pushing member which pushes on the exterior surface of the roll of insulation material as the carriage moves along the length of the purlins, thereby assisting in unrolling the roll of insulation material so that the roll of insulation material moves simultaneously with the plate.

12 Claims, 4 Drawing Sheets

PUSHING MEMBER FOR APPARATUS FOR PAYING OUT A ROLL OF INSULATION MATERIAL

TECHNICAL FIELD

This invention relates to the construction of an insulated metal roof structure for use in commercial and industrial buildings.

BACKGROUND ART

Metal roof structures typically comprise a series of parallel rafter beams extending across the building in one direction and purlin beams parallel to each other mounted on top of the rafters extending in a direction normal to the rafters. Insulation material in long sheets is placed in the area between purlins. The sheets of insulation material can be laid along the length of the purlins or across the purlins in a direction normal to the purlins. If desired, the roof structure can have a first layer of insulation material which is laid along the length of the purlins, and a second layer of insulation material which is laid laterally across the purlins on top of the first layer on insulation. Hard roofing material such as metal decking is then attached on top of the purlins over the insulation material. Because the hard roofing material comes in long sheets and the roofs generally have two sloped sections, it is customary to construct the roof along the length of the structure from one end to the other. The workers stand on the previously laid section of roof to construct the next section.

The insulation material must be supported between the purlins beneath the hard roofing material. Various methods of supporting the insulation material have been used. Mounting straps or wire mesh which are attached to or draped over the purlins forming a lattice have been used. This is referred to as banding. A sheet, typically made of vinyl and acting as a vapor barrier, is then rolled onto the lattice, and insulation material is placed between adjacent purlins and over the sheet. If the installation of the lattice is done from underneath the roof structure, scaffolding or lifting equipment is typically required for installation. Since the lattice encompasses the entire roof, installation is costly and time consuming. Once the hard roofing material is mounted on the purlins, the sheet can support the insulation material and the lattice no longer serves any useful purpose.

Some systems dispense with the lattice and use the sheet itself to support the insulation material. The support sheet is draped from the adjacent purlins and the insulation material is placed on top of the support sheet. A carriage has been used to aid in the dispensing of the support sheet. The carriage is positioned on top of the purlins and travels the length of the purlins during the roof construction. A roll of the support sheet material is mounted on the carriage and the support sheet is payed out from the roll and placed on top of the purlins. As the carriage travels the length of the purlins, the support sheet is draped across the purlins.

Insulation material which is laid along the length of the purlins on top of the support sheet is typically dispensed from a roll. After each movement of the carriage, the workers push each individual roll of insulation material a sufficient distance so that the next sheet of hard roofing material can be fastened to the purlins. Typically, the workers push each roll of insulation material by kicking the rolls in the direction of carriage movement. Although this system of pushing each roll of insulation material has been found to be adequate, it is inconvenient and time consuming to push each roll, after every relatively small carriage movement.

An alternative to manually unrolling the roll of insulation is to mount the roll of insulation material on a mandrel so the insulation material can be payed out as the carriage moves along the roof. The mandrel is typically an elongated rod which is placed through the center of the roll of insulation material. The mandrel is rotatably fastened to a framework or cradle which is mounted on the carriage, thereby supporting the roll of insulation material axially. As the carriage moves along the length of the purlins, the insulation is payed out from the rotating roll. This system eliminates the need for the workers to separately push each roll of insulation material as the carriage is periodically moved. However, after a roll is completely dispensed, a new roll has to be inserted on the mandrel and then placed on the framework. Since a typical roll of insulation material is relatively short compared to the length of the roof, a new roll will frequently have to be inserted. For example, a roll of insulation material having a desired recovery thickness of about 6 to 8 inches (15 to 20 cm) is only about 25 to about 30 feet (9.1 to 10.9 m) long. This system is, likewise, time consuming and inconvenient.

It would be desirable to have an apparatus for assisting in the building of a roof structure which is efficient and convenient to use.

DISCLOSURE OF THE INVENTION

There has now been invented an improved apparatus for providing a roof structure, where the apparatus includes a plate upon which is rested a roll of insulation material, and further includes a pushing member which assists in unrolling the roll of insulation material. The apparatus provides for a convenient and efficient system for building roof structures.

The present invention comprises an apparatus for providing a roof structure having a plurality of purlins spaced apart from one another in a parallel arrangement. The apparatus includes a carriage which is movable in a downstream direction along the length of the purlins. As the carriage moves in the downstream direction, a support sheet for the support of insulation material is payed out so that the support sheet depends from adjacent purlins.

The apparatus further includes a plate which is attached to the carriage. The plate supports a roll of insulation material which is resting on the plate and which is unsupported axially. The insulation material is connected at the upstream end of the roof structure and is payed out on top of the support sheet as the carriage moves along the length of the purlins. Preferably, the plate is built with strength sufficient for fall protection for the workers. The apparatus also includes a pushing member which pushes on the roll of insulation material as the carriage moves along the length of the purlins, thereby assisting in unrolling the roll of insulation material so that the roll of insulation material moves simultaneously with the plate. The pushing member can be attached to the carriage or the plate.

In a specific embodiment of the invention the pushing member is a rib which extends upwardly from the plate. The rib extends laterally across the plate and is positioned on the upstream side of the roll of insulation material. Preferably, the rib has a trapezoidal cross-sectional shape forming a sloped side oriented in the downstream direction so that it can push the roll of insulation. In another embodiment, the pushing member is an upwardly extending plate.

DETAILED DESCRIPTION

Figures 1, 2:
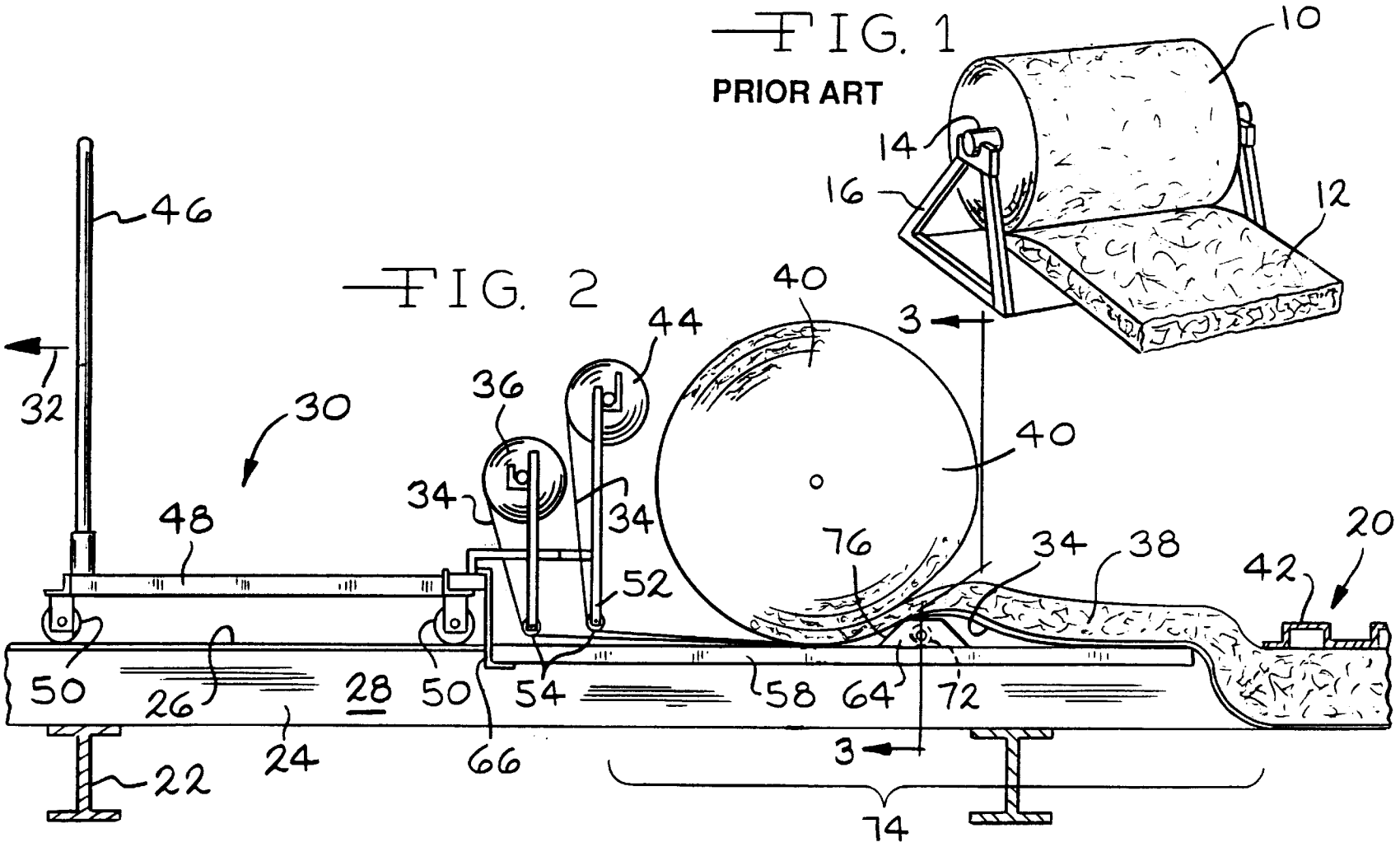
FIG. 1 PRIOR ART
FIG. 1 is a schematic perspective view of a prior art roll of insulation material which is supported axially.
FIG. 2 is a schematic side elevational view of the carriage of the present invention on top of a roof structure.

There is shown in FIG. 1 a prior art method of supporting a roll 10 of insulation material 12, in which the roll is mounted on a mandrel 14. The mandrel is rotatably fastened to a framework 16, thereby axially supporting the roll of insulation material.

Figure 3:
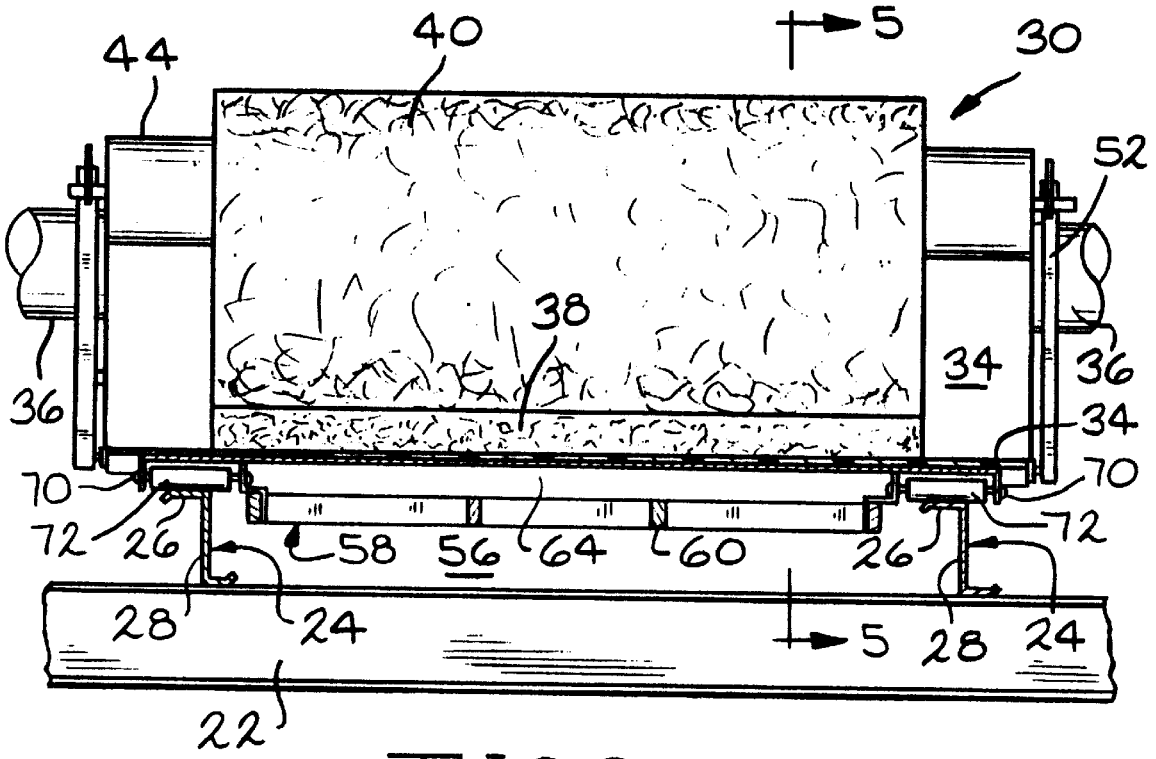
FIG. 3 is a sectional view taken along line 3—3 of FIG. 2.

There is illustrated in FIG. 2 a building roof structure, indicated generally at 20. The roof structure is supported by main rafter beams 22 which are positioned parallel to each other. A plurality of purlins 24, spaced apart and arranged parallel to each other, are fastened on top of the rafters in a direction normal to the rafters. The spacing of the purlins is typically 5 feet (1.82 m) on centers. As shown in FIG. 3, the purlins have a generally Z-shaped cross-section and include a top portion 26 and a vertical portion 28. Roof structures may also be constructed using bar joists or trusses, and the invention as described herein will work equally well with purlins, bar joists or trusses. The use of the term "purlins" in this specification and claims includes not only traditional purlins, but also joists, trusses, and other similar structural members.

Broadly stated, the roof structure is constructed by use of a carriage 30 which rides on the top portion of the purlins and travels along the length of the purlins in a downstream direction, represented by an arrow 32. As the carriage is moved, a support sheet 34 is payed out from a roll 36. The support sheet is draped on top of adjacent purlins so that the support sheet depends from the top portion of the purlins. The support sheet supports a layer of insulation material 38 which is placed on top of the support sheet between the adjacent purlins. The insulation material is payed out from a roll 40. After the insulation material has been placed on the support sheet, long sheets of hard roofing material 42, such as metal roof decking, are then attached to the top portion of the purlins over the support sheet and insulation. The hard roofing material can be fastened to the purlins in any suitable manner, such as by threaded fasteners or clips. The attachment of the hard roofing material presses down on the support sheet edges which are sandwiched between the top portions 26 of the purlins and the hard roofing material 42, so that the support sheet supports the insulation between the purlins.

Because the hard roofing material comes in long sheets, typically 30 to 35 feet (10.9 to 12.8 m), and the roofs generally have two sloped sections, it is customary to construct a first section of the roof structure along the width of the sloped section and then proceed along the length of the structure from one end to the other. The workers stand on the previously attached first section of the roof structure to assemble the next section of roof. The carriage travels along the length of the purlins and is moved by the workers as each new section of roof is assembled.

Although the accompanying Figures show a carriage extending between only two adjacent purlins, the carriage can be any length up to the width of the roof itself. Preferably, the carriage is comprised of a plurality of carriage sections which can be joined together so that they span the entire width of the sloped section of the roof. The carriage is then propelled across the purlins by pulling means, such as a winch (not shown), in the downstream direction 32 so that all the carriage sections move in unison. Because the support sheet is draped across the top portion of adjacent purlins, the total width of the support sheet is wider than the distance between the purlins. Therefore, adjacent support sheet rolls are not co-linear and must be slightly staggered. Typically, a carriage section covers two purlin spans, i.e., about 10 feet (3.7 m) in length. Preferably, each carriage section has both a leading roll 36 and a trailing roll 44 of insulation support sheet, one roll for each of purlin span. The edge of the support sheet from the trailing roll 44 will be draped on top of the edge of the support sheet from the leading roll 36 as the carriage moves in the downstream direction. Multiple identical carriage sections, each having a leading and trailing roll, can, therefore, be joined together, with every roll being staggered from an adjacent roll.

The carriage can be any suitable apparatus which moves along the top of the purlins and dispenses the support sheet. As seen from FIG. 2, the carriage 30 includes safety handrails 46 and a deck 48 for the worker to stand on while operating or moving the carriage. Preferably, the carriage has hourglass-shaped rollers 50 riding on the top portion 26 of the purlins 24 for ease of movement and to maintain the carriage in alignment with the purlins. The carriage also includes a framework 52 for mounting the rolls 36 and 44. Although two support sheet rolls are shown in FIG. 2, one is the leading roll 36 shown in the background, and the other is the trailing roll 44 shown in the foreground. Mounted on the framework are turning bars 54 which extend laterally across the support sheet and are positioned slightly above the top portions 26 of the purlins 24 so as to direct the support sheet to a generally horizontal position.

The space between the vertical portions 28 of adjacent purlins 24 defines an insulation cavity 56, as seen from FIG. 3. The insulation cavity has a generally rectangular cross-sectional shape. It is advantageous to fill out the insulation cavity uniformly with the insulation material without leaving relatively large gaps, thereby maximizing the insulating qualities of the roof structure. The purpose of the support sheet is to support the insulation material in the insulation cavity, but the support sheet can also be used as a vapor barrier, and for aesthetic purposes. A pleated support sheet which reduces the width of the rolls 36 and 44 can be used. The pleated support sheet unfolds as it is payed out in the insulation cavity. The support sheet can be of any suitable material for the stated purposes, such as vinyl or foil faced paper.

Figure 4:
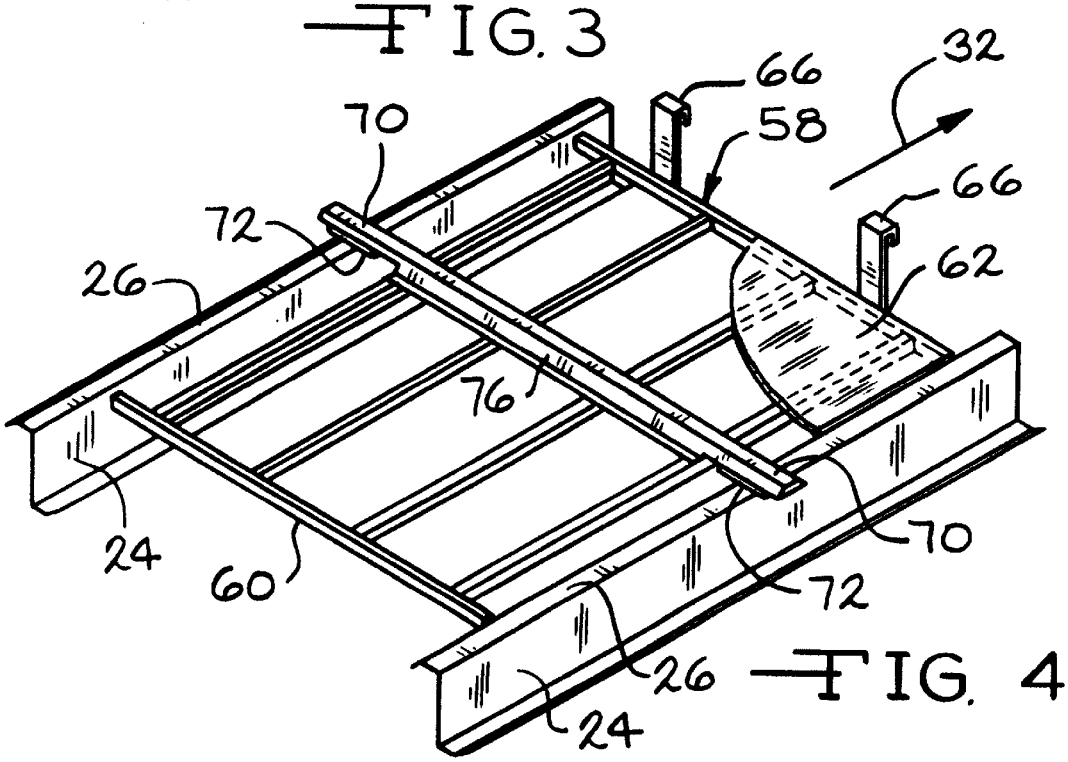
FIG. 4 is a partially cutaway, schematic perspective view of the plate shown supported between two portions of adjacent purlins.

Attached to the carriage 30 is a plate 58 which extends from the carriage 30 in an upstream direction opposite the downstream direction 32. The plate 58 supports the roll 40 of insulation material. The plate 58 also supports the payed out portion of the support sheet so that the support sheet does not drape downwardly, thereby pulling the longitudinal edges of the support sheet off of the top portion of the purlins. It can be seen that by resting the insulation roll 40 on the plate the mandrel 14 of FIG. 1 is not needed. The plate also provides for wind resistance, and if built with sufficient strength, the plate can be used for fall protection for the workers to prevent them from falling off the leading edge of the previously completed section of roof. As used in this specification and claims, the term "fall protection" means that the carriage and the plate will withstand a live load of 25 lbs./ft$^2$ (1200 N/m$^2$). This should be adequate to support a worker inadvertently stepping onto the plate. As shown in FIG. 4, the plate includes a skeleton framework 60. The top surface of the skeleton framework is covered with an upper surface 62 preferably made of a material having low frictional characteristics. The upper surface, however, can be constructed in any suitable manner.

The plate 58 further includes a pushing member, such as a rib 64, which extends upwardly from the plate. The rib extends across the width of the plate in a lateral direction with respect to the downstream direction 32. The roll of insulation material is positioned between the rib 64 and the framework 52 of the carriage 30 so that the rib is on the upstream side of the roll of insulation material. The roll of insulation material is preferably unsupported axially when resting on the plate. The rib pushes on the exterior surface of the roll of insulation material as the carriage and plate move in the downstream direction, thereby assisting in unwinding the roll of insulation material.

The plate can be attached to the carriage by any suitable means, but preferably is attached to the carriage by a plurality of hooks 66 which extend vertically from the plate, thus attaching one end of the plate to the carriage. The hooks can also be threadably fastened to the carriage. The other end of the plate is supported by a pair of roller assemblies 70 which extend laterally outward from the plate. Each roller assembly includes a roller 72 which rolls on top of the top portion 26 of the purlins 24. The roller assemblies are preferably housed within the rib 64 so that the insulation material does not get caught in the rollers. The plate follows the carriage as the carriage moves along the length of the purlins. Generally, the plate is located in a gap 74 which exists between the completed section of the roof structure 20 and the carriage 30, as shown in FIG. 2. The plate hinders wind from blowing vertically through the gap 74, thereby preventing the wind from disturbing the insulation material 28 and the support sheet 24.

As the carriage travels along the length of the purlins, the support sheet 34 and the insulation material 38 are payed out from their respective rolls 36 and 40. The payed out end of the support sheet and insulation material are connected to the upstream end of the completed roof structure. If the plate 58 did not have a pushing member, such as the rib 64, the insulation roll might have a tendency to slide on the support sheet, and therefore, not unroll as the plate moved out from underneath the support sheet. The rib, however, extends upwardly from the plate, thereby inhibiting the insulation roll from remaining stationary with respect to the ground as the plate moves. Therefore, the rib assists in unwinding the roll of insulation material by pushing on the exterior surface of the roll so that the roll moves simultaneously with the plate. After the insulation has been fully payed out, a new roll is simply placed on the plate, and the end of the insulation material is tucked into the insulation cavity. After the hard roofing material is fastened to the purlins above the end of the insulation material, the insulation material is frictionally held and connected to the completed section of the roof.

Figure 5:
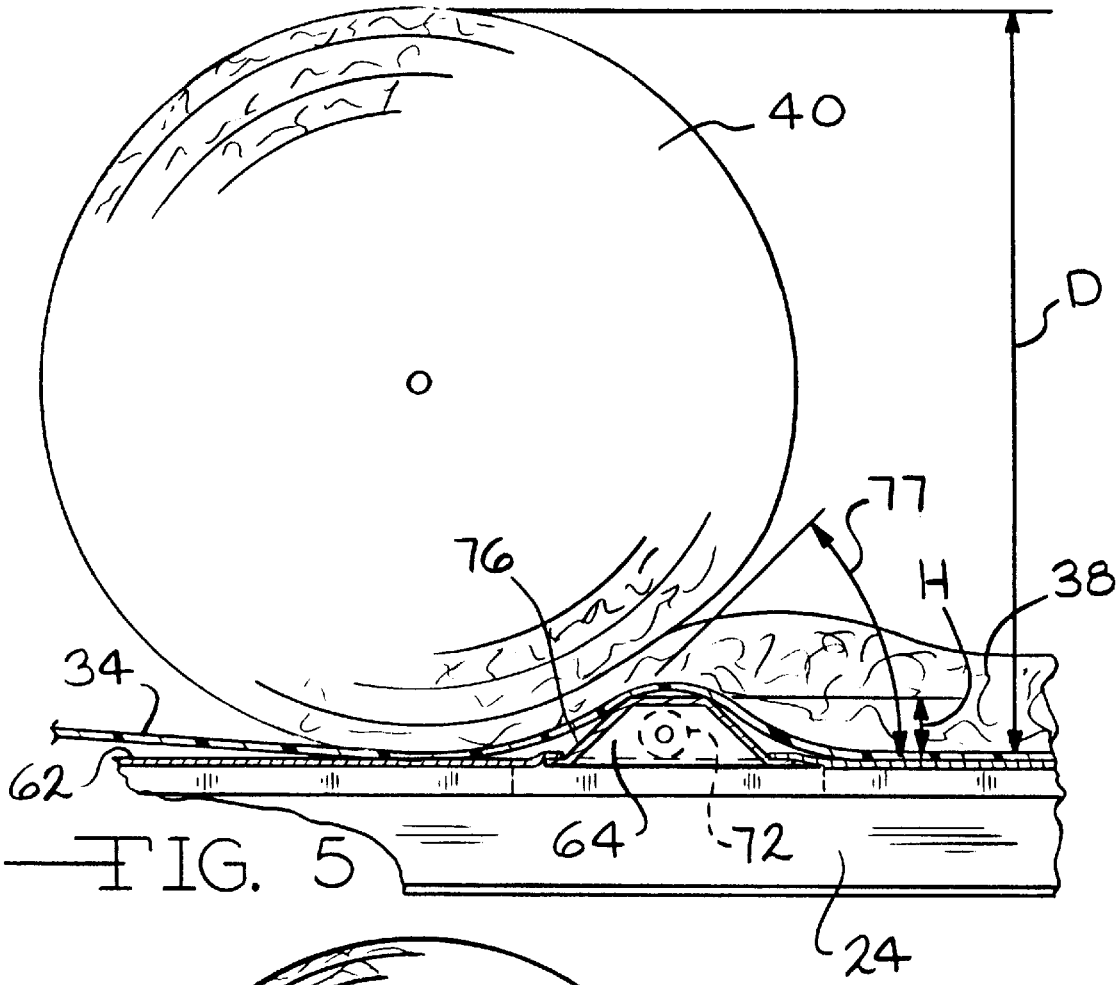
FIG. 5 is a sectional view taken along line 5—5 of FIG. 3.

As shown in FIGS. 2 and 5, the rib has a trapezoidal cross-sectional shape forming a sloped side 76 which faces the roll of insulation material. The trapezoidal shape of the rib provides rigidity for the plate for fall protection purposes. The sloped side of the rib is at an angle 77 with respect to the plate, as shown in FIG. 5. The sloped side provides for a gradual surface for the support sheet and insulation material to slide against and helps prevent tearing of the support sheet and insulation material as they are payed out. It has been found that a sloped side having an angle 77 within the range from about 30 to about 60 degrees with respect to the plate is preferred.

As shown in FIG. 5, the rib has a vertical height H as measured from the upper surface of the upper surface 62 of the plate, and the roll of insulation material 40 has a diameter D when the roll is at its largest diameter, i.e., in its unrolled condition. The height of the rib H must be of a sufficient height to prevent the roll from merely rolling over it, while small enough so that the support sheet and the insulation material can freely slide over the rib. Preferably the height H of the rib is at least 5 percent of the initially packaged diameter D of the roll of insulation material.

Figure 6:
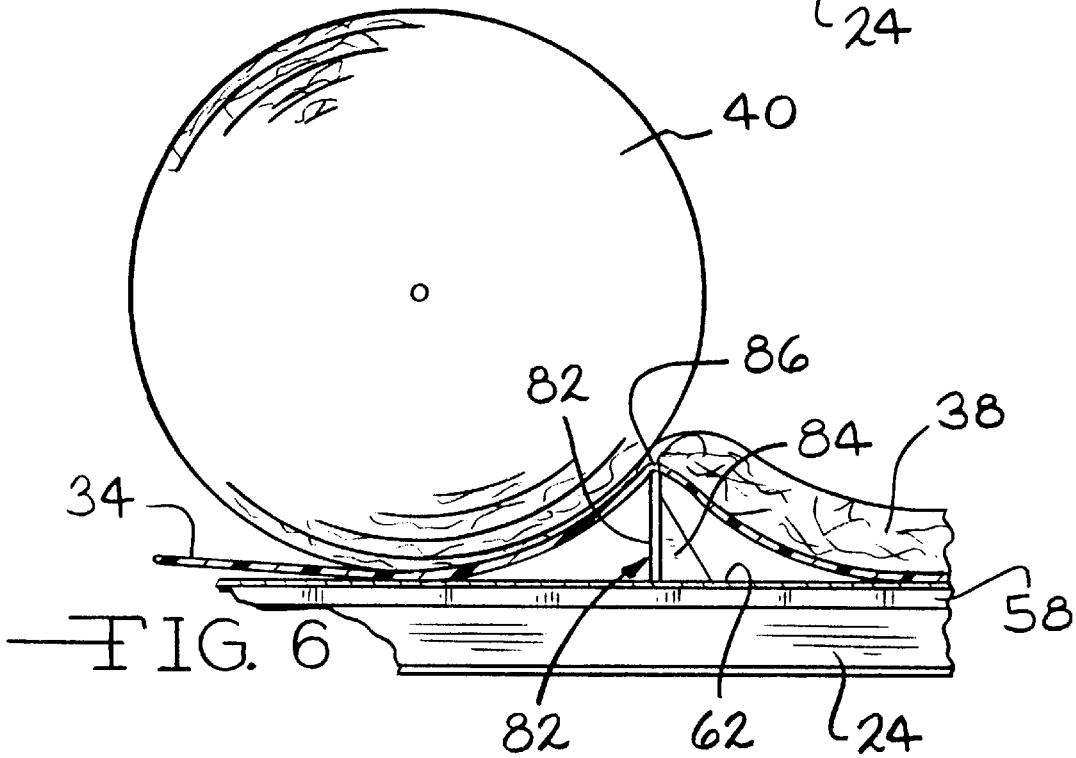
FIG. 6 is a schematic side elevational view illustrating an alternate embodiment of a pushing member having an upwardly extending plate.

FIG. 6 illustrates an alternate embodiment of a pushing member 80 which includes a flange 82 which extends upwardly from the plate, and which extends laterally across the plate. The flange can be attached to the plate by any suitable means, such as by welding the flange to the plate and being supported by angle brackets 84. The flange preferably has a rounded edge 86 to help prevent tearing of the support sheet 34 and the insulation material 38.

Figure 7:
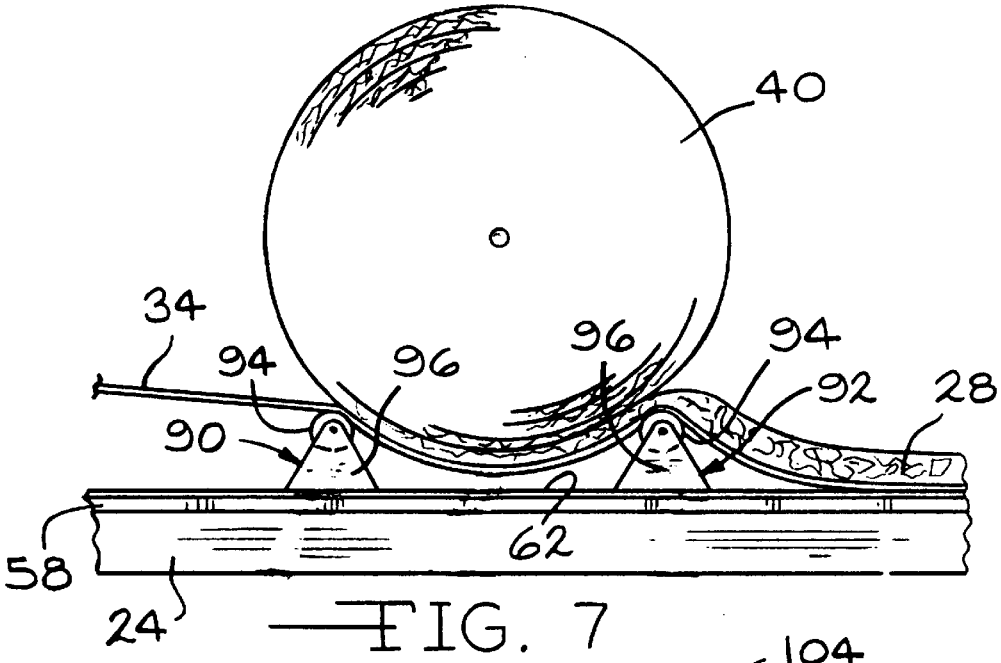
FIG. 7 is a schematic side view of another alternate embodiment in which there are two pushing members positioned on both sides of the roll of insulation material, and in which the pushing members include rollers.

FIG. 7 illustrates another embodiment in which there are two pushing members 90 and 92. The pushing member 92 is positioned on the upstream side of the roll 40 of insulation material, and the pushing member 90 is positioned of the downstream side of the roll of insulation material. Each pushing member 90 and 92 includes an elongated roller 94 which extends laterally across the plate. The rollers are rotatably mounted on brackets 96 which are attached to the upper surface 62 of the plate 58. The support sheet is draped over both of the pushing members 90 and 92, and the roll of insulation material is placed on top of the support sheet between the two pushing members.

Figure 8:
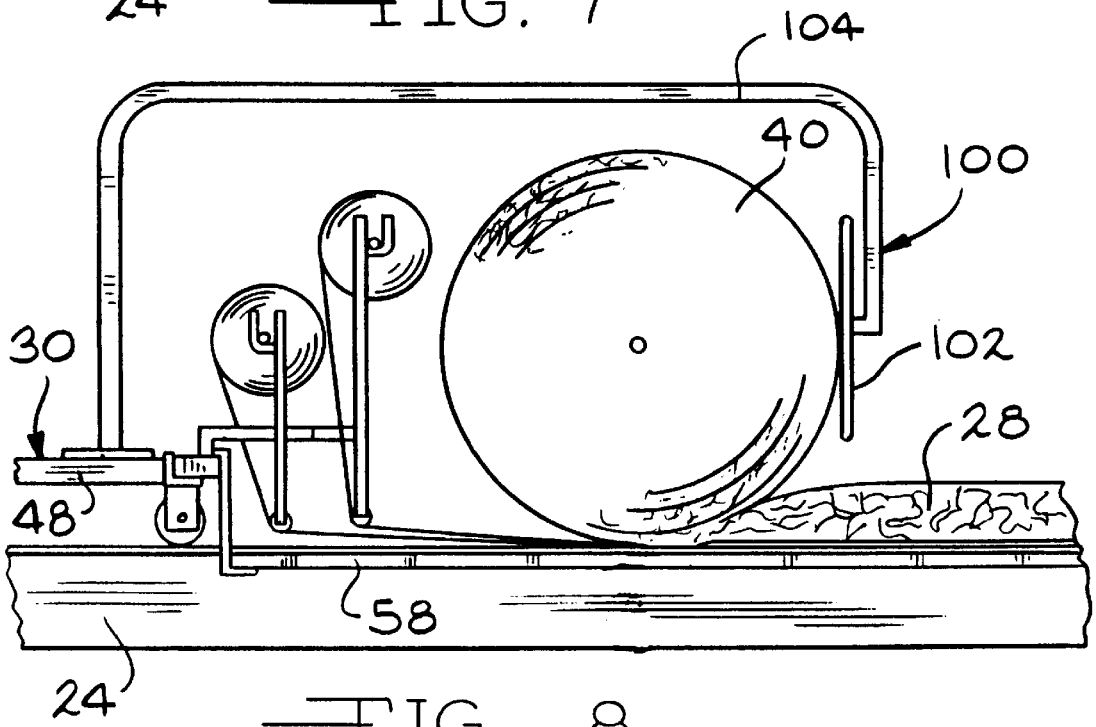
FIG. 8 is a schematic side elevational view of another alternate embodiment of a pushing member which is mounted on the carriage.

FIG. 8 illustrates yet another embodiment of a pushing member 100 which is mounted on the carriage 30 instead of the plate 58. The pushing member includes a generally vertical plate 102 which is positioned on the upstream side of the insulation roll 40. Preferably, the vertical plate is made of a material having low frictional characteristics. The vertical plate is supported by a support bar 104 which is attached to the deck 48 of the carriage and extends up over the roll of insulation material. The vertical plate functions in the same manner as the other pushing members of the present invention by pushing the roll so that the roll moves simultaneously with the vertical plate as the carriage moves along the length of the purlins. Although the support bar 104 is shown extending up over the roll of insulation material, the support bar can also be wrapped around the ends of the roll.

Although the carriage in the accompanying Figures is shown having the support sheet 34 resting on top of the plate 58, the carriage could be modified so that the plate rides on top of the support sheet, thereby assisting in holding down the edges of the support sheet against the top of the purlins. Therefore, the insulation material would rest directly on the plate. Also, the carriage 30 and the plate 58 could be incorporated into a single structure.

It will be evident from the foregoing that various modifications can be made to this invention. Such, however, are considered as being within the scope of the invention.

INDUSTRIAL APPLICABILITY

The invention can be useful in the construction of roof structures for commercial buildings.

We claim:

1. In combination:

1) An apparatus for insulating a roof structure having a plurality of purlins spaced apart from one another in a parallel arrangement, the apparatus comprising;

a carriage movable in a downstream direction along the length of the purlins, the carriage having a roll of support sheet mounted thereon, wherein movement of the carriage in the downstream direction dispenses the support sheet so that the support sheet depends from adjacent purlins;

a plate attached to the carriage to support a roll of insulation material, the plate having a generally horizontal planar surface having a width which extends substantially between adjacent purlins; and a pushing member mounted on the plate; and 2) a roll of insulation material resting on the plate and positioned adjacent the pushing member, the insulation material being connected at the upstream end of the roof structure and payed out on top of the support sheet as the carriage moves in the downstream direction, the roll of insulation material being pushed by the pushing member as the carriage moves.

2. The apparatus of claim 1 in which the pushing member is mounted on the carriage.

3. The apparatus of claim 1 in which the plate extends in an upstream direction from the carriage, the plate being sufficient for fall protection such that the plate is able to withstand a load greater than 1200 $N/m^2$.

4. The apparatus of claim 1 in which the pushing member is an upwardly extending flange.

5. The apparatus of claim 1 in which the pushing member includes a roller for engaging the roll of insulation material.

6. The apparatus of claim 1 in which the pushing member is a rib extending upwardly from the plate.

7. The apparatus of claim 6 further including a roller assembly mounted on the plate and housed within a portion of the rib, the roller assembly adapted to support the plate as the carriage moves along the length of the purlins.

8. The apparatus of claim 6 in which the rib has a trapezoidal cross-sectional shape which provides for structural reinforcement of the plate.

9. The apparatus of claim 6 in which the rib has a sloped side facing the downstream direction which is angled within the range from about 30 to about 60 degrees with respect to the plate.

10. An apparatus for providing a roof structure having a plurality of purlins spaced apart from one another in a parallel arrangement, the apparatus comprising;

a carriage movable in a downstream direction along the length of the purlins, the carriage having a framework adapted to support and dispense a roll of support sheet for support of insulation material as the carriage moves along the length of the purlins so that the support sheet depends from adjacent purlins;

a plate attached to the carriage, the plate having a generally horizontal planar surface having a width which extends substantially between adjacent purlins, the plate adapted to support a roll of insulation material which is resting on the plate, the insulation material being connected at the upstream end of the roof structure and payed out on top of the support sheet as the carriage moves along the length of the purlins;

a rib mounted on the plate and extending upwardly therefrom, the rib positioned on the plate so as to push on the exterior surface of the roll of insulation material as the carriage moves along the length of the purlins, thereby assisting in unrolling the roll of insulation material so that the roll of insulation material moves simultaneously with the plate; and a roller assembly housed within a portion of the rib, the roller assembly adapted to support the plate as the carriage moves along the length of the purlins.

11. The apparatus of claim 10 in which the rib has a sloped side which pushes on the roll of insulation material.

12. The apparatus of claim 10 in which the plate extends in an upstream direction from the carriage, the plate being sufficient for fall protection such that the plate is able to withstand a load greater than 1200 $N/M^2$.

* * * * *